United States Patent [19]

Bowman

[11] Patent Number: 4,927,290

[45] Date of Patent: May 22, 1990

[54] MANHOLE COVER SUPPORT RESISTANT TO WATER INFILTRATION

[76] Inventor: Harold M. Bowman, 18867 N. Valley Dr., Fairview Park, Ohio 44126

[21] Appl. No.: 378,412

[22] Filed: Jul. 11, 1989

Related U.S. Application Data

[63] Continuation-in-part of Ser. No. 207,325, Jun. 15, 1988, abandoned, and a continuation-in-part of Ser. No. 201,573, Jun. 1, 1988, Pat. No. 4,867,600, and a continuation-in-part of Ser. No. 207,266, Jun. 15, 1988, Pat. No. 4,867,601, and a continuation-in-part of Ser. No. 207,185, Jun. 15, 1988, Pat. No. 4,872,780, and a continuation-in-part of Ser. No. 362,216, Jun. 6, 1989, and a continuation-in-part of Ser. No. 362,257, Jun. 6, 1989, each is a continuation-in-part of Ser. No. 76,668, Jul. 23, 1987, Pat. No. 4,834,574.

[51] Int. Cl.[5] ..... E02D 29/14

[52] U.S. Cl. ..... 404/26; 52/20

[58] Field of Search ..... 404/25, 26; 52/19, 20, 52/21; 49/41, 466, 483, 505; 210/166; 277/207 A

[56] References Cited

U.S. PATENT DOCUMENTS

| | | | |
|---|---|---|---|
| 1,908,909 | 5/1933 | Manz | 52/19 |
| 3,773,428 | 11/1973 | Bowman | 404/26 |
| 3,891,337 | 6/1975 | McCoy | 404/26 |
| 4,440,407 | 4/1984 | Gagas | 277/207 A X |
| 4,582,450 | 4/1986 | Neil | 404/26 |
| 4,828,274 | 5/1989 | Stannard | 404/25 X |
| 4,834,574 | 5/1989 | Bowman | 404/26 |

*Primary Examiner*—Jerome W. Massie
*Assistant Examiner*—Matthew Smith
*Attorney, Agent, or Firm*—Watts, Hoffmann, Fisher & Heinke Co.

[57] ABSTRACT

A manhole cover support resistant to infiltration of surface water is shown. Such support is adapted for emplacing over and raising the effective grade of an existing manhole cover receiving structure and accommodating a new layer of paving around its perimeter and a manhole cover therewithin. The support is characterized by: a body that has at least one adjustable joint for rendering the cover support adjustable in its outer perimeter dimension, the body comprising a base having a ledge for a manhole cover, the ledge having a lateral cover keeper arising therefrom; and deformable seal elements comprising synthetic and/or natural resin-containing material, the seal elements being adapted to interact with deformable plug means for the adjustable joints to block substantial infiltration of surface water, and one of the seal elements being disposed on the ledge and at least another of the seal elements being disposed substantially around the outer perimeter of the body.

22 Claims, 3 Drawing Sheets

MANHOLE COVER SUPPORT RESISTANT TO WATER INFILTRATION

REFERENCE TO OTHER APPLICATIONS

This patent application is a continuation-in-part of applicant's U.S. patent application Ser. Nos. 07/207,325, filed on June 15, 1988, abandoned, with the same title as this application; 07/201,573, filed on June 1, 1988, entitled *Polygonal Manhole Cover Support* U.S. Pat. No. 4,867,600; 07/207,266, filed on June 15, 1988, entitled *Sturdy Adjustable Manhole Cover Support* U.S. Pat. No. 4,867,601; 07/207,185, filed June 15, 1988, entitled *Manhole Cover Support With Box Flanging* U.S. Pat. No. 4,872,780; 07/362,216, filed June 6, 1989, entitled *Manhole Cover Support With Interbraced Top Members* (pending); 07/362,257, filed June 6, 1989, entitled *Multicomponent Bases and Wales for Manhole Cover Supports* (pending); and his application Ser. No. 366,177, filed on June 13, 1989, entitled *Manhole Cover Support Having Enhanced Grip.* These applications are continuations-in-part of applicant's Ser. No. 07/076,668 of July 23, 1987, now U.S. Pat. No. 4,834,574. The teachings of those applications are incorporated herein by reference.

BACKGROUND OF THE INVENTION

This invention relates to adjustable manhole cover supports for emplacing over and raising the effective grade of an existing manhole cover receiving structure.

For simplicity the terms "existing manhole cover receiving structure" and "manhole cover" herein are used to refer to the existing, i.e., fixed in-place frame or other existing seating receptacle for a removable cover or grating that covers an access hole (i.e., hand hole, tool hole, manhole, catch basin or the like), and that cover or grating ordinarily is intended to bear vehicular traffic. The term "manhole cover support" or simply "cover support" here means a structure that fits over the existing manhole cover receiving structure, raises its grade, and thereby accommodates a cover or grating at the new grade. Advantageously, the cover or grating is the same one that was used at the lower grade. The access hole covered is a utility enclosure serving, e.g., an electric, gas, water, sewer or storm drainage system.

Ordinarily the instant cover support finds its use when a roadway such as a street or highway is resurfaced with an added layer of paving material, typically asphalt concrete or sheet asphalt, to establish a higher grade. It then is advantageous to mount the inventive cover support atop the existing manhole receiving structure. Prior art on manhole cover supports and manhole cover frames can be found in U.S. Pat. Nos. 4,281,944, 4,236,358, 3,968,600, 3,773,428, 4,097,171, 4,302,126, 3,891,337 and 1,987,502. The first four of these are for inventions of the applicant.

Axle loads up to 40,000 pounds must be resisted by many of these cover supports as well as serious impact loads from vehicles and snow plows, a variety of temperature effects, steam leaks, spillage, etc., without permitting a hazardous dislocation of the cover support or its cover. Often it is desirable also to cushion the cover for resisting wear or reducing noise, and/or to seal the cover and its cover support against a substantial and possibly overloading infiltration of surface water, e.g., storm drainage that otherwise would enter a sanitary sewer system at various manhole locations. Adjustability of the cover support in peripheral dimension and height also is important for accommodating the wide range of specifications to be met.

Clearly the resistance to displacement from traffic loading and impact is a paramount concern and a most general one. The supports often contain some reasonably thin (0.1 inch or less) elements such as sheet steel elements. These can include upwardly projecting cover keeper wall portions, flanging, and bases. Such thin keeper portions can be fitted into an existing manhole cover frame and, normally, still leave a large enough opening at the new-grade to accommodate the same old cover or lid which was used on the existing frame. The lighter weight elements also can be effective for economy and/or ease of manufacture, handling and installation. However, a relatively low weight of the cover support, as compared to the usually thick cast iron fixture on which it is to rest, makes it a candidate for displacement in service. This is true even when a cover support can be expanded against the rising shoulder of a receiving structure such as a manhole cover frame in the manner of various prior art cover supports such as those in U.S. Pat. Nos. 4,281,944, 4,236,358, 4,097,171 and 4,302,126, noted above. Where the retention is mainly due to the weight of a cover and its support, displacement is even more of a risk.

The instant support can be made especially highly resistant to displacement and dislodgement in service without being made ponderous in weight, even when it has no mechanical fastening to the receiving structure. Thus, while the present cover support can be made to incorporate conventional structural or mechanical holddown means that are integral with it or easily attached, the cover support also can do a good job of holding in (being retained in the existing receiving structure while in service) by friction alone.

Installing, adjusting, loading and unloading and otherwise handling manhole cover supports and removing manhole covers usually is done with powerful and indelicate tools such as picks, pinch bars, crowbars, tongs, heavy hooks and the like. Deformation of the cover support can occur, particularly about its upper edge which is nearest the road surface. The upper edge usually is the handiest area for applying lifting and other tools. Deformations of the edge never are good, and they can render the opening of the support unfit for service. Hence, overall ruggedness and stiffness against deformation, especially at or near the top rim, and resistance to displacement are major concerns about manhole cover supports.

On the other hand, a relatively light construction of the cover support, in comparison to the ponderous cast iron frame that usually initially supports the manhole cover when the first paving is laid, can be very desirable, provided, however, that an inordinate amount of the ruggedness, stiffness, and resistance to displacement or dislodgement is not sacrificed. Usually a main place for weight reduction is in the lateral keeper for the cover. Another place is in the base of the cover support. Clearly the economics of manufacture, handling and installation all are generally in favor of lower weight. A relatively thin wall keeper would normally be of steel, the wall rarely being more than about 0.1 inch (12 ga.) thick, usually less.

The present adjustable support lends itself to being sealed off against water infiltration and to cushioning the cover. Furthermore, it can be made very stiff or especially durable even when employing relatively thin metal for some or all of the various body elements.

No previously proposed manhole cover supports are known by the inventor to be able to develop the retentional friction that this one can develop, let alone to include as well at least another of the additionally desirable features such as sealing off water infiltration, modest weight coupled with high stiffness and/or special durability.

BROAD STATEMENT OF THE INVENTION

The instant manhole cover support is for making installations that are resistant to the infiltration of water into the systems to which they provide access. It is adapted for accommodating a layer of paving around its outer perimeter and a manhole cover therewithin while raising the effective grade of an existing manhole cover receiving structure such as an existing manhole cover frame or other existing cover support that has a manhole cover sill and an inside shoulder surface rising therefrom. The cover support is characterized by:

- a body that has at least one adjustable joint for rendering the cover support adjustable in its outer perimeter dimension,
- the body comprising a base having a ledge for supporting the manhole cover,
- the ledge having a lateral cover keeper arising therefrom; and
- deformable seal elements comprising synthetic and/or natural resin-containing material,
- the seal elements being adapted to interact with deformable plug means for the adjustable joints to block substantial infiltration of surface water,
- one of the seal elements being disposed on the ledge and at least another of the seal elements being disposed substantially around the outer perimeter of the body.

BRIEF DESCRIPTION OF THE DRAWINGS

FIG. 1 is a top plan view of a preferred nominally 36-inch diameter split-ring embodiment of the instant cover support adapted to fit a circular manhole and having a bonded-on seal element and retention component and a bonded-on polymer seat and seal element;

FIG. 2 is a vertical cross section of FIG. 1 taken through Section 2—2;

FIG. 3 is a vertical cross section of FIG. 1 taken through Section 3—3;

FIG. 4 is a side elevation view of the cover support of FIG. 1;

BEST MODE FOR CARRYING OUT THE INVENTION

Figure 1:
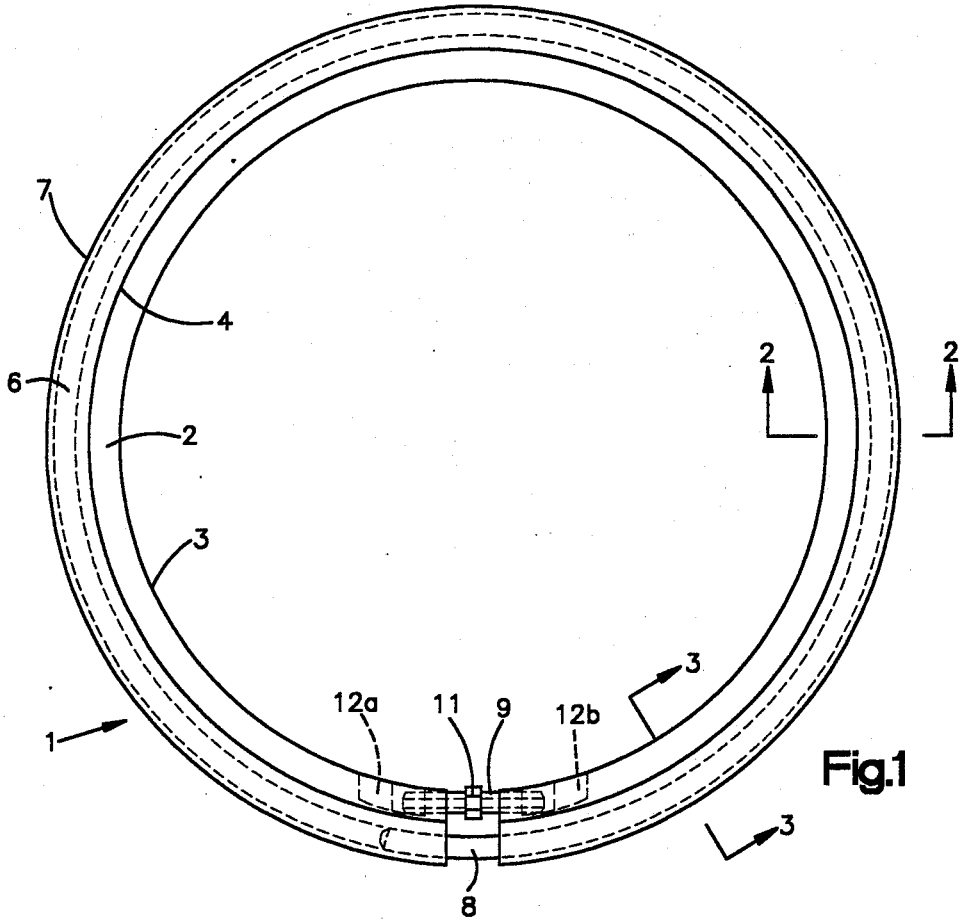
FIGS. 1-4 illustrate adjustable cover supports with practically vertically rising cover keeper walls. Such keepers necessarily must be thin-walled to fit into an existing frame and still accommodate the original cover. In other words, that cover must lie flat on the new seat that is bounded by the walls of such keeper. In various other embodiments of the invention the keeper walls can rise with a slight outward slant.

Reference is made to FIG. 1. The cover support broadly is indicated by arrow 1. Seat 2 for the cover is a polymeric seal and cushioning element on the top of the cast ductile iron (ASTM type 536, Grade 60-45-12) base of this cover support. Its inner vertical wall is one inch in height, item 3. Welded to and rising up from the outside top edge of the base is a lateral keeper 4 for the cover. The keeper of 13 ga. (0.09395″) steel. The top 6 of the keeper is formed into a hollow ($\frac{3}{4}\times\frac{3}{4}$″ inside dimensions) wale having outside wall 7.

The base and keeper, including the wale, form an almost complete circular pattern which is interrupted only by a joint that is connected with a turnbuckle bolt 9 and is bridged with tapered steel shaft 8.

The right end of the shaft is of essentially square cross section, and it makes a snug fit into, and is welded into, the hollow channel part of the wale. The left end of the shaft 8 is somewhat tapered, and it makes a slidable fit into the other end of the hollow channel part of the wale. Thus the entire wale can be considered to be the box flanging around the upper periphery of the keeper and the shaft 8 across the joint.

The ends of the turnbuckle bolt 9 are threaded with opposite handedness to open up the gap of the joint when turned one way, and to close the gap when turned the other way with a wrench acting on wrench grip 11. For security in service, a nylon locking patch is applied to the bolt threads. The bolt 9 is of A.1.S.1 type 302 stainless steel; each end of it runs into a horizontal tapped hole in the base. The holes are tapped appropriately for bolt adjustment and extend to reach the notches **12*a* and 12*b*. The notches accept the protruding ends of bolt 9** when the gap is shortened.

If a greater amount of peripheral adjustment and greater frictional grip of the base into a manhole frame or the like is desired, a pair or two pairs (or more) of diametrically opposed joints of the type connected by bolt 9 can be used in the cover support. Thus, the cover support will be made of two or four (or more) segments, usually of equal size, if the cover is circular. However, if the cover support is rectangular or otherwise polygonal or oval in plan, the joints can be at corners or on the sides; the resulting connected segments, while usually making a generally symmetrical whole in plan, will not necessarily be of equal size.

Figure 2:
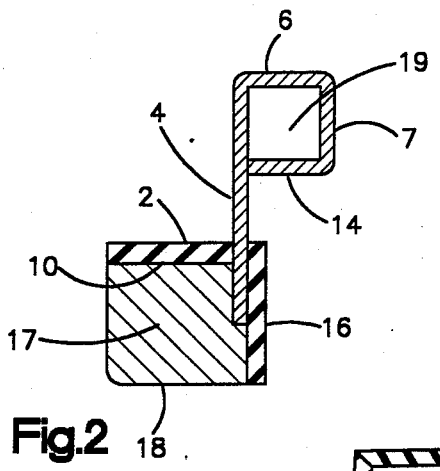

The elements of the cross section shown in FIG. 2 include those with the same numbers as used in FIG. 1 plus these: 17, the cast ductile iron base; 10, the top of the base; 19, the hollow channel of the wale; 14, the bottom of the wale which can be tack-welded along the outside of keeper 4; cover seat 2, an eighth inch thick slightly foamed elastomer bonded to the top of the base; bottom 18 of the base which is to rest on the existing manhole cover receiving element; and a frictional retention member and wall-sealing component 16 which is about an eighth inch thick of slightly foamed elastomer bonded to the base all around its outer perimeter. Sheet steel keeper 4 is welded to base 17 and any lumps, spatter, etc. are removed, e.g., ground off the outer and inner seams that it makes with the base.

Figure 3:
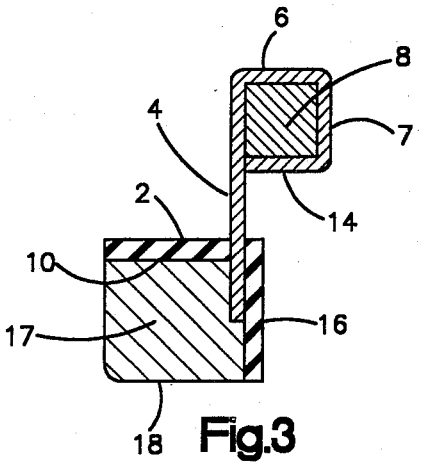

The elements of FIG. 3 are the same as those of FIG. 2 except that the wale at this zone includes shaft 8 as an integral (e.g., welded-in) part.

Figure 4:
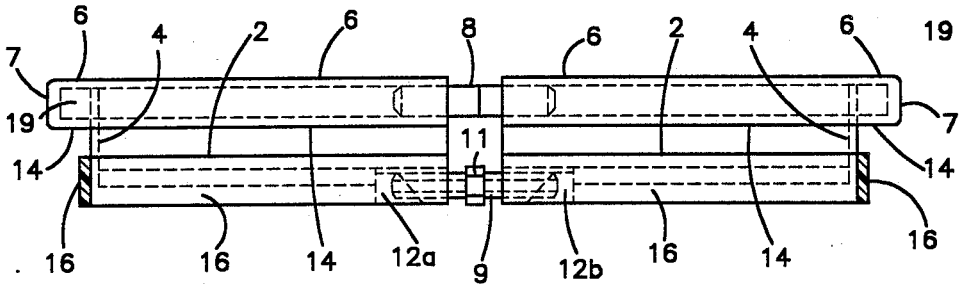

The elements of FIG. 4 that also are shown in FIGS. 1, 2 and 3 have the same numbers as in those figures. Thus, item 16 is the frictional retention member and wall-sealing component, 8 the shaft and 19 the hollow channel of the wale, 9 the turnbuckle bolt, 17 the wrench grip of the bolt, and 12*a* and 12*b* the left and right notches, respectively, for permitting protrusion thereinto of the bolt ends. If desired, the retention component can be a separate strip or strips of flexible, compressible polymer interposed between the base and the existing manhole cover receiving structure instead of such polymer being bonded on. Furthermore, it can be in the form of one or more bands or O-rings surrounding and even elastically gripping the base, e.g., in grooves therein. Likewise, the seal element that makes the seat for the manhole cover can be in the form of a washer or gasket or one or more (concentric) rings, e.g., O-rings, and that element need not be bonded to the cover support.

The cover support embodiment shown in FIGS. 1, 2, 3 and 4 has a good frictional grip to an existing manhole cover frame because of a desirably high coefficient of static friction between a ferrous metal surface and the surface of the baked-on polymer. Such coefficient for many conventional flexible deformable polymers, including many foamed elastomers, and metal surfaces can be much greater than that between two plain metal surfaces. Thus, the coefficient of static friction for the contact of a desirably gripping polymer to a metal should be at least about 0.4, and generally it can be as high as 0.6–0.7 or even higher. In a steel-to-steel instance it is unlikely to be as high as 0.35. Shore A Durometer hardness of the polymer composition for the retention member and all sealing components preferably is at least about 20, and preferably it is about 50–70. Oil resistance can be desirable for them and the other water-sealing elements in some installations.

The coefficient of static friction is the ratio of the maximum force parallel to the surface of contact which acts to prevent motion between two bodies at rest in contact with each other from sliding over each other, to the force normal to the surface of contact which presses the bodies together. Thus, the turnbuckle or other conventional spreader means, usually screwed types, at the joints supply a large measure of pressure, and the bonded elastomer heightens friction, thereby making a cover support that is unusually effective for resisting dislodgement or tilting in highway service. Means for locking down the cover support to an existing manhole cover flange, e.g., like the means shown in U.S. Pat. No. 3,773,428, often are desirable in addition to simply a frictional grip, and often can be imperative for cover supports of fixed perimeter.

Figure 5:
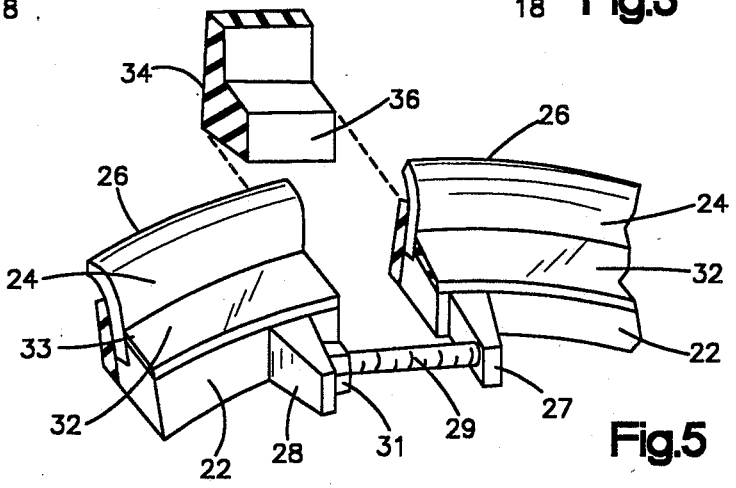
FIG. 5 is a fragmentary perspective view of the joint area of a split ring cover support embodiment of the invention with the sealing plug for its joint gap shown detached from that gap. The right side of the ring is shown broken off, and the left side is drawn as being cut off (for simplicity)

In FIG. 5 the eight-inch thick slightly foamed elastomer (a cured vinyl plastisol) seat 32 for the manhole cover is bonded to the top of the cast ductile iron base 22. A like layer 33 is bonded on the outside of the base and runs a short way up the lower outside of keeper 24. The keeper rises with a slight outward slant and has a short lip or flanging 26 at its top.

Solid reaction post 28 projects inwardly from the base near the left side of the joint gap. Post 27 has a hole with tapped threads, and it projects in a similar way at the right side of the gap. Both are of cast ductile iron molded integrally with the rest of the base ring. The head 31 of the spreader bolt 29 rests against the reaction post 28; the bolt 29 screws into the threaded hole of the post 27. Lengthening of the bolt between the posts springs the base ends farther apart, i.e., the base end 23 makes a larger gap with its opposing end (that is not visible in this view).

Softer flexible polymer foam plug 36 fits into the gap with a very slight compression. The plug can be cemented into place, e.g., with suitable rubber cement on side 34 of the plug to adhere to the unseen side of the base and the keeper at the gap.

Figure 6:
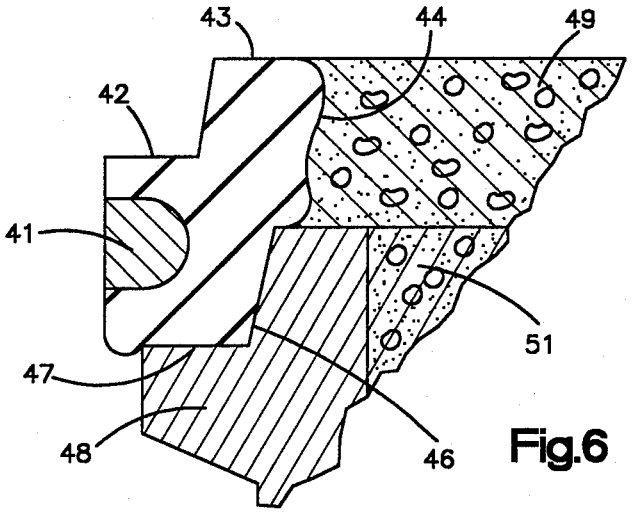
FIG. 6 is a cross sectional elevation of a four-segment circular cover support of this invention installed in a resurfaced street, the exposed part of the body being mainly flexible polymer stressed from the inboard side with a metal body frame. The section is taken in the center of a segment between turnbuckle bolt expanders.

In FIG. 6, tough, dense, slightly elastic composition compounded with Neoprene (a trademark of E.I. du-Pont de Nemours and Company) forms most of the flexible, compressible cover support body visible in this view. Thus, the seat 42 receives the cover. The cover support rests on sill 47 of existing cast iron manhole cover frame 48. The lower or base portion 46 of the cover support body is forced against the inner surface of the shoulder of the manhole cover frame 48 by stress from expanded steel body frame (ring) segment 41. The pressure makes a slight bulge (exaggerated in the drawings) at the top of the shoulder. Subsequently asphalt concrete is forced against the outer wall 44 of the cover keeper and brought flush with the keeper top 43. Under the asphalt paving layer is the original portland cement concrete paving 51.

Figure 7:
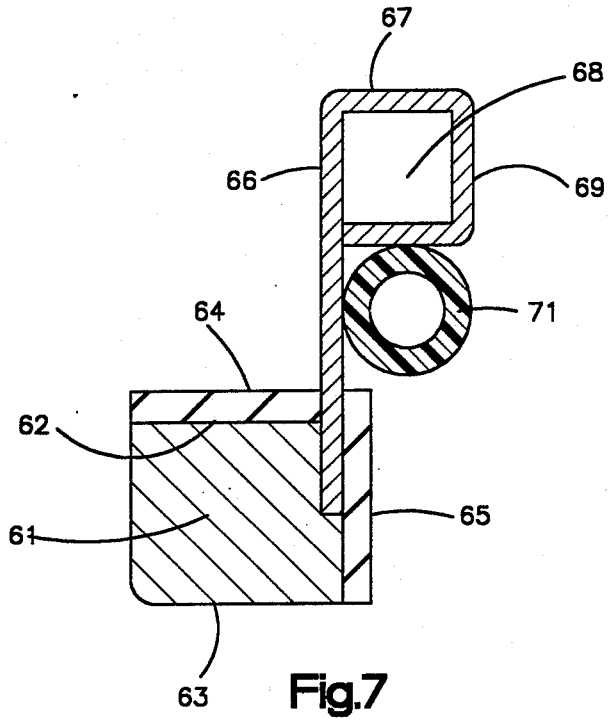
FIG. 7 is a vertical cross section of a cover support like that sectioned for FIG. 2, except that it has a gas filled tube around the body.

FIG. 7 shows a gas-filled tubular seal 71 disposed around the keeper 66 of a cover support that is otherwise like the cover support sectioned for FIG. 2. The tube acts as a water seal for the outer wall of the keeper.

The elements of the cross section shown include: 61, the cast ductile iron base; 62, the top of the base; 68, the hollow channel of the wale; 67, the top of the wale around keeper 66; 69, the side of the wale; cover seat 64, an eighth inch thick slightly foamed elastomer bonded to the top of the base; bottom 63 of the base which is to rest on the existing manhole cover receiving element (not shown); and a frictional retention member and sealing component 65 which is about an eighth inch thick of slightly foamed elastomer bonded to the base all around its outer perimeter. Sheet steel keeper 66 is welded to base 61.

Turnbuckle bolts (not shown but each like stainless steel bolt 9 of FIG. 1) are disposed inboard of the flat side of the four equal-sized body frame segments such as the segment 41. The bolts have nylon locking patches and are threaded on each end. Each bolt screws into a pair of appropriately tapped steel lugs (not shown) that project inwardly from a segment near the opposing ends of a joint gap. The lugs on a segment are formed integrally with that segment. Where hold-down means, such as screw clamps running from the base down and under the existing sill are to be used, they can be fastened to the steel segments. The joints can be sealed in a manner set forth hereinafter.

For simplicity, the rubber part of the body of the cover support was shown without any re-enforcing cloth, wire, or cord embedded in it, although this is often desirable, as is the compounding of the rubber material with special fillers such as carbon black.

In the embodiment shown in FIG. 6, the main seal elements and retention component part shown are the seat portion 42 and the outer wall portion 46 of the segment of the base of the cover support. These surfaces are integral with the rest of the segment except the steel frame segment 41. These seal and retention component elements can be made softer or harder than the main depth of the rubbery part of the body, usually softer for sealing, e.g., by building up layers with the softest on the outside. Alternatively, a separate sealing and/or special retention component material (usually softer than the core, e.g., a foamed elastomer), can be used over them, either bonded to the rubbery body surfaces or simply interposed as separate elements where sealing and friction is particularly desired.

It is possible to use various conventional elevating means to adjust the level of the cover support. Thus, lifting bolts may be threaded into the bottoms of metal bases, or shims or gaskets can be put under the bottom of the base.

Suitable synthetic or natural resinous materials that can be formulated into compositions for use in the compressible retention component and water seals herein include rubber and plastic materials such as natural and synthetic rubbers, water-resistant ionomers, various vinyl polymers and copolymers such as polyvinyl acetate-polyethylene-acrylate copolymers and polyvinyl chloride homopolymers, polyurethanes, polyester resins, epoxy resins, styrene-containing copolymers such as ABS and butadiene-or isoprene-styrene copolymers, rosin and rosin derivatives, thick tars and pitches, polyolefins and copolymers containing olefin units, and aminoplasts. Plasticizers, pigmentation, stains and/or mineral fillers such as talc, carbon black, etc. commonly are employed in their recipes. Cork particles bonded with such resin material as a binder can be useful, also. The preferred retention components, in addition to being deformable, appear to be elastomeric. Many of them can be foamed and preferably are foamed only very slightly; this can soften them a bit, and it makes them slightly less dense than without the foaming. Latent foaming agents, reactive upon warming and/or catalyzing, and incorporated in a film of an uncured polymer-providing material coated on a cover support are preferred. Curing with heat, ultraviolet or electron beam radiation and/or catalysis can be practiced.

Customarily, it is of advantage to prime the metal with a bonding agent or use a bonding treatment to secure the best bond of the sealing component or a water sealing element to metal. Some polymers can bond well without this, e.g., epoxy resins. However, the bonds of most are improved by such priming and/or treating.

A preferred foamed plastisol formulation for a sealing component is of Shore A Durometer hardness about 20–70, and preferably about 50–65, as are the water seals. The plastisol is compounded principally from low molecular weight polyvinyl chloride resin plasticized heavily with a conventional phthalate ester plasticizer. It contains minute percentages of stabilizer, red pigment and ozodicarbonamide blowing agent. Another preferred formulation of about the same Shore A Durometer hardness is a flexible polyolpolyurethane foam, slightly elastomeric and rubbery. Some polymer recipes need heat to cure and foam, even with catalysis, and others cure and even foam at about room temperature (78° F.). The degree of foaming in both these plastisol and urethane formulations is very small, and it could be called almost microscopic and slight—the bubbles are closed-cell and tiny. In some cases, especially where sealing is to be maximized and strength considerations are secondary, a large degree of foaming and a resulting softened and less dense foamy structure can be tolerated, e.g., Shore A Durometer hardness of 20–55.

A recipe for a slightly-foamed polyurethane rubber that has been found to be quite effective here is as follows:

100 weight parts of Adiprene #L167 polyurethane, a product of the Uniroyal component of the F.G. Goodrich Company, Naugatuck, Conn.

Compounded with these additives:

0.3 weight part of water;

0.3 weight part of Dabco-33LV, a product of Air Products, Inc., Allentown, Pa.;

1.4 weight parts of DC-193, a product of Dow-Corning Inc., Midland, Mich.; and 16.0 weight parts of "BC", a product of Palmer, Sieka Inc., Port Washington, N.Y.

This material can be applied to warmed, cleansed and bonding agent-treated cast iron and steel, then heated to 250°–350° F. to develop the foam and full cure of the polymeric material.

Some preferred heat-curable plastisol sealing component recipes for various Durometer hardness contain 100 parts of low molecular weight polyvinyl chloride resin plasticized with 60–70 parts of a conventional phthalate plasticizer such as diootyl or dimethyl phthalate. With this 1–3 weight parts of a conventional stabilizer for PVC, e.g., a lead-based stabilizer, is used along with 1–2 weight parts of a red colorant (other pigments and colors, or none, can be used, if desired) and 0.5–3 weight parts of a conventional ozodicarbonamide heat- and water-activated blowing agent.

The preferred foamed plastisol usually is sprayed on the area to be coated. It is advantageous to spray it onto the hot metal cover support body (370°–380° F.) and let it cure and foam a bit. If extra foaming and/or curing is desired, the coated part can be further warmed at 380°–400° F. for up to a few minutes.

Metal surfaces should be cleaned to accept the polymeric material if it is to be bonded thereto. Then a customary bonding agent such as Chemlok #218 (Manufactured by Lord Corporation, Erie, Pa.) is applied, dried and warmed. Various other useful bonding agents are available such as a Pliobond type (made by the Goodyear Tire and Rubber Company).

As shown above, the preferred materials of construction for most of the cover support, i.e., the body and various elements of the body, are of a ferrous metal, e.g., steel and/or cast iron, particularly cast ductile iron. Other metals can be used where their special properties are desirable and their cost can be tolerated), e.g., stainless steel, high tensile strength steel, wrought iron, bronze, brass, etc. Also suitable in some cases, cover support parts, and even much of the main body structure, can be fabricated from glass fiber-, aramid fiber-, or graphite fiber-re-enforced resin, e.g., a thermosetting (curable) resin such as a polyester or epoxy resin. Also highly filled polymers including elastomers, or ABS plastic and the like, i.e., tough structural polymeric materials can be used in the invention. In some instances, it is possible to fit an expansible metal shape, e.g., a body frame such as an expansible steel hoop, to the inside part of a manhole cover support body. The body is otherwise almost entirely a tough, flexible polymeric material, optionally pigmented (filled) with, e.g., carbon black. Also, it may optionally be built up in plies with glass, nylon, cotton and/or steel cloth, wire and/or cords (like a truck tire carcass). In some such instances, the outer part of the body can act as a retention and sealing component, although softer polymer-containing films often can be used with advantage as special retention components over the cover support body.

Reference is made again to FIGS. 2, 3 and 4 which display a split-ring cover support with the bonded polymer retention and sealing component 16 and to FIG. 6 which shows a four-segmented circular manhole cover support. In tests on related nominally 23-inch circular four-segmented manhole cover supports also joined with turnbuckle bolts and having a bonded-on slightly foamed elastomer retention component (actually a heat-cured vinyl plastisol retention component) the following significant fact was revealed: pulling directly upward on an expansible cover support that was held in a ring of steel by only the friction between its elastomer-coated periphery and the ring and its own weight (which was only an inconsequential minute percentage of the whole load to be pulled) took much more force (3250 pounds) to remove than a like four-segmented cover support held the same way in the ring with the same hoop stress exerted, but having no such retention member interposed. The force factor was about 1.38 times as much for the coated support as for the uncoated one.

This series of tests also showed that the force factor for the four-segmented, 23-inch diameter cover support with the polymeric retention component had a force factor that was 1.41 times that of its split-ring counterpart which also had the same sort of retention component. Further, it was found that the force factor for that so-coated split-ring counterpart was roughly double that of a like steel split-ring cover support that had no such polymer retention component at all. Additionally, the tests indicated that the strain distribution around the four-segmented cover support was far more even than that around the split-ring cover support. In a further test, a nominally 24 inch diameter four-segment cover support, like that of FIG. 6 and having the preferred cured plastisol retention component, required 4750 pounds of vertical pull to pull it out of the steel test ring.

This testing of an expandable, nominally 23-inch (outside diameter) split ring 1 inch high by ¾ inch thick and equipped with strain gauges, the ring being held in a manhole frame, further indicated that there was appreciable nonuniform bending in the ring as the gap therein was widened only slightly to force the ring strongly against the frame.

Accordingly, a finite element analysis of a 1 inch by 1 inch split ring (23½ inches in outside diameter) held in a 1 inch by 1 inch cast iron frame (having a 23¾ inch internal diameter) was undertaken by computer. The material properties listed below were used, the force was reckoned in increasing finite increments, and the materials were assumed to be elastic with large deformations.

| Component | Young's Modulus | Poisson's Ratio |
|---|---|---|
| Frame (cast iron) | $2.9 \times 10^7$ psi | 0.3 |
| Split Ring (steel) | $2.9 \times 10^7$ psi | 0.3 |

At expansion forces of 2400 to 3000 pounds localized ring-to-frame contact was found. This was consistent with the previous ring-with-strain-gauge tests. From the previous tests about 3000 pounds appeared to be a high practical loading for a ring equipped with a ½-inch diameter threaded bolt for expansion. At the 3000 pound force the gaps between the ring and the frame (calling for fill, e.g. with a frictional retention and sealing component, to complete the compressive contact between ring and frame) ranged from 8 to 19 mils with an average of 11 mils. Based on this analysis the thickness of the frictional retention component would need to be at least between 8 and 9 mils thick for a good grip and also for having it constitute a reasonable water barrier between the base of the ring and the shoulder surface against which it reacts. To put this into perspective, architectural paint coatings and primers for steel work on bridges normally are about 1½ to 2 mils thick; the usual heavy industrial and maintenance protective paint coatings can reach about 3 mils, and occasionally they approach 5. Paint films in general are expected to be less than 4 mils thick; thicker than that, the films usually are termed "coatings" rather than "paints". They often are referred to as coatings of a special type, e.g. coal tar epoxy finishes of 10 mils, and some other specialty coatings that can be even thicker.

One must expect some asperities and irregularities in surface and shape of the cover supports and frames as well as wear, customary size variations in frames of the same nominal sizes, the variability of the outward flare in the keeper walls of the frame, and the fact that an expanding ring of a support, even a multisegmented one with the superior gripping property as compared to a split ring, deviates more and more from a true circle as it is expanded. Plus or minus an ⅛ inch per foot is the customary tolerance for cast iron made for this service. Hence, least about 20 mils is the preferable lower value for thickness of the seal element on the outer wall of the cover support and about 60–130 mils (almost 1/16 to slightly over an ⅛ inch) is a bit more comfortable in the typical service situation.

On the other hand a thickness of as much as about 500–600 mils for such wall sealing component around the outer wall of the base of the body often can be tolerated in some cases, but beyond that this deformable, compressible seal component is likely to be the main if not all of the material in contact with and supported directly by the seat or sill of the manhole cover frame, and this can be undesirable. Furthermore, especially where the keeper wall of the new cover support being emplaced approaches being vertical, the original manhole cover is unlikely to fit the new support. Accordingly about 400 mils thickness is a preferred upper limit for this wall sealing component (which also can supply frictional grip between a manhole cover frame and the cover support).

For efficiency and economy and the broadest application to general service situations, a thickness of such wall sealing component approximately about 1/16 to an ⅛ inch thickness (e.g. about, 60–130 mils) is the most highly preferred. Clearances of about an ⅛ of an inch are generally all that can be counted on consistently for existing covers. As these sealing and frictional retention components are new to the field of manhole cover supports, the foregoing critically of their thicknesses appears not to have been considered by practitioners of the art heretofore.

The cushioning and sealing of seats for the manhole cover can be done with the same material as useful for the wall sealing, although the thickness is not as critical. Generally the seal on such seat will be about 50–500 mils thick and it can be thicker.

If the adjustable joints of such cover support are plugged with deformable polymer (e.g., elastomeric compositions like those discussed herein in connection with retention components and seals, and especially foamed elastomer, so that complete water seals result under the manhole cover 81 and all around either the outer perimeter of the cover support base or its cover keeper rising there around, or both) then the cover support with an imperforate cover can be used to resist stray surface water such as storm drainage.

Suitable sealing plug fitments to be used with the cover support as it is being installed can be made of polymer or with a core or armature, e.g., one of metal, coated with polymer. Alternatively, the plug fitment can be formed after the cover support is installed by stuffing in or spraying into the gap a sealant, advantageously a flexible one and preferably a foaming or foamable-in-place one.

Hollow peripheral encircling wales (re-enforcing rim) portions and hollow base portions can be filled or partly filled with a hard or tough resin, optionally mixed with a mineral filler such as mica or chopped glass fiber strand, to supply desirable further resistance to crushing and other deformation. Thermosetting resins such as polyester and epoxy resins can be useful in this connection. Also, thermoplastic ones such as ABS resin can be so used, or even a concrete such as a Gunnite type.

The cross section of the sleeves and wales and bases may be other than squarish or rectangular. They can be made with many other fairly rigid conformations, e.g., triangular or rounded, etc. The same applies to the cross section of solid or tubular wale-forming and base-forming members and joint-bridging rod or tube elements. While only solid bases have been illustrated, it should be clear that they can be made hollow, e.g., like the main part of the wale of FIG. 1. Advantageously, hollow wales and hollow bases can be formed from sheet steel (e.g. 12–16 gauge) pieces that are separate from the wall portions of the keeper and of the base, then welded to such wall portions. Thus, for example, a U-shaped channel forming the top, outside and bottom of the wale in FIG. 2 can be welded to the upright keeper 4.

While the cover support embodiments depicted are for circular holes, other shapes such as rectangles, triangles, squares, ovals, etc. are usable in accordance with invention principles, provided the cover supports are rendered adjustable as to their perimeter, usually with turnbuckle means.

It is especially desirable with polygonal (e.g., rectangular) manhole cover supports to have essentially horizontal turnbuckle bolts biased across the corners, and these bolts set inboard as much as is permissible, usually at least one inch, from the side of the cover support to which they directly deliver a component of their pressure.

The turnbuckle bolts biased at the corners impart components of force that are axial to and perpendicular to the straight lateral segments of the cover support that they connect. For the particular bias of 45° relative to the longitudinal axes of the straight sides of a rectangular or square cover support, the magnitude of each such component is 0.707 times the bolt force. Positioning these bolts in the same plane as, but at virtually any other angle oblique to the corner it connects, i.e., biasing the bolt, is, of course, possible and practical in accordance with this invention. The perpendicular component of force holds the lateral side (segment) directly against the existing manhole frame. The axial component of force, being located inboard from the outer edge of the cover support, provides a bending moment on the lateral segment that actually increases the holding force between the periphery of the cover support and the existing manhole frame.

The conventional positioning of an expansion element such as a turnbuckle or spreading bolt somewhere along the longitudinal axis of the lateral segment, usually in the middle, exerts essentially only an axial force. Also a deleterious bending moment can be imparted to such bolt and segment. The bolt and its segment are apt to bow-up, down, or in towards the center of the manhole when especially heavily forced. Accordingly, it can be said that corner-spreading makes the bending moment on the bolt work for improved retention in the existing manhole cover frame (or other existing cover-receiving structure such as an existing cover support) instead of being useless or possibly even deleterious to the new cover support.

For a rectangular nominally 24"×48" cover support the holding force has been calculated to be 26,600 pounds on each side, or a total of 106,400 pounds for the whole support. This compares quite favorably with that estimated for the same size cover support of the conventional (spread at the centers of the side lateral segments) design where both cover supports used the same kind of ½" turnbuckle bolts. In such conventional instance, the holding force was only 25,000 pounds on each side or 100,000 pounds for the whole support.

The holding forces for one side of a rectangular cover support with the corner spreaders can be calculated in accordance with the following formula "F", below, employing inch, pound and degrees of arc units:

$$Hc = \frac{4EA_tB_Tl}{l_B}\,\mathrm{Cos}\Theta + \frac{8 \cdot E \cdot A_t \cdot B_T \cdot l \cdot X}{l_B S} \cdot \mathrm{Sin}\Theta, \text{ i.e., Formula "F"}$$

where:

Hc = the holding force in pounds perpendicular to the manhole cover frame (but limited in magnitude by the yield strength of the bolt)

E = Young's modulus of the bolt in pounds per square inch $A_t$ = tensile area of the bolt in square inches $B_T$ = the number of bolt turns after the cover support is seated l = the lead (inches) of the bolt threads $l_B$ = the length of the exposed bolt in inches.

X = the perpendicular distance in inches from the contact periphery of the cover support to the center of the hole that is tapped therein for accepting the turnbuckle bolt S = the length of one side of the cover support in inches $\theta$ = the angle in degrees that longitudinal axis of turnbuckle bolt makes with the longitudinal axis of the side being held against the frame.

This equation, Formula F, can be simplified when the angle $\theta$ is 45° as it is in the embodiment shown in FIG. 1. The equation becomes:

$$Hc = \frac{2 \cdot 2 \cdot E \cdot A_tB_Tl}{l_B}\left(l + \frac{X}{S}\right), \text{ i.e., Simplified Formula "F"}$$

Relative to the foregoing force considerations is the realization that the placing of the turnbuckle bolt is significant for developing lateral force, the force that is important for cover support retention in highway service. Thus, keeping the bolt hole opening (or the end pivot point of a turnbuckle having a screw protruding obliquely into a female-threaded end of a center turning member of a more common turnbuckle bolt) far inboard makes for a higher force value than putting it closer to the contact periphery of the cover support (which contacts and presses against the existing cover frame—or other existing manhole cover receiving structure). The inboard placement of any turnbuckle or like spreader mechanism, of course, permits longer threaded sections and allows for more peripheral adjustment. However, while many manhole covers have a reasonably flat top, they also can have a bottom that is reenforced by ribs, bracing, or like structure hanging down under; these cannot be interfered with, lest the cover won't seat in the newly-installed cover support. Accordingly, there can be a limit: to the inboard placement of the spreader.

Advantageously, then, for developing improved retaining force and permitting substantial adjustment with such biased turnbuckle spreader means, the perpendicular distance from the contact periphery of the cover support to center point where the spreader means starts to shorten or lengthen should be at least about one inch and preferably is more, e.g., one and a half inches. Stated in another way, "X" in the above equations should be at least an inch; or, as the force is being applied by the spreader to a zone near the end of a side segment, this zone can be treated as having a practical center point, and the perpendicular distance from that center point to the contact periphery of the straight-sided segment should be at least about an inch. The 45° angle biasing tends to develop about equal force in two directions, and this generally is desirable.

Modifications and variations of the invention will be apparent to those skilled in the art in the light of the foregoing detailed disclosure. Therefore, it is to be understood that, within the scope of the appended claims, the invention can be practiced otherwise than as shown and described.

I claim:

1. A manhole cover support adapted for accommodating a layer of paving around its outer perimeter and a manhole cover therewithin while raising the effective grade of an existing manhole cover receiving structure, the existing receiving structure having a manhole cover sill and an inside shoulder surface ascending therefrom, the manhole cover support comprising:

a body that has at least one adjustable joint equipped with spreader means for rendering the cover support adjustable in its outer perimeter dimension, the spreader means being capable of creating a gap in the base upon expansion of the body;

a plurality of deformable seal elements comprising synthetic or natural resin-containing material; and compressible plug means for each said adjustable joint, the plug means comprising synthetic and/or natural resin-containing material, the body including a base having a ledge for supporting the manhole cover, the ledge having a lateral cover keeper arising therefrom, the base having an outer wall, at least part of which is adapted to react around its periphery against said shoulder surface upon expansion of the body with the spreader means, one of the seal elements being disposed on the ledge and at least one other of the seal elements being disposed substantially around the outer perimeter of the body including at least the outer wall of the base thereof, the seal element around the outer wall of said base being sufficiently thick for obtaining continuity of contact between said outer wall and said shoulder surface, the continuity being interrupted only by the gaps in the base, the minimum thickness of the seal element around the outer wall of the base being between 8 and 9 mils, the maximum about 600 mils, the coefficient of static friction of the seal element around said outer wall with respect to said shoulder surface substantially exceeding the coefficient of static friction obtainable directly between said outer wall and said shoulder surface, the plug means being adapted to interact with the seal elements at the gaps to block substantial infiltration of surface water into the manhole.

2. The cover support of claim 1 which has elevating means to adjust it in height.

3. The cover support of claim 1 wherein the body is in the form of a split ring with a joint that can be spread apart and drawn together.

4. The cover support of claim 1 wherein the body is in the form of a plurality of joined segments that can be spread apart and drawn together.

5. The cover support of claim 1 wherein the body and the receiving structure are substantially of ferrous metal, and the thickness of the seal element around the outer wall of the base is at least about 20 mils.

6. The cover support of claim 1 wherein said seal elements comprise a polymer having Shore A hardness of at least about 20.

7. The cover support of claim 1 wherein said seal elements comprise a foamed elastomer.

8. The cover support of claim 1 wherein said seal elements comprise a cured plastisol.

9. The cover support of claim 1 wherein said seal elements comprise polyurethane.

10. The cover support of claim 1 wherein said seal elements comprise epoxy resin.

11. The cover support of claim 1 wherein at least a part of one of said seal elements is bonded to the body.

12. The cover support of claim 1 wherein at least one of said seal elements is in the form of a band or an O-ring that is not bonded to the body.

13. The cover support of claim 1 wherein each joint is provided with a sealing fitment as the deformable plug means.

14. The cover support of claim 1 wherein the exposed part of the body is mainly a flexible polymer, and it is stressed by an expansible metal body frame.

15. The cover support of claim 14 wherein the exposed part of the body is a filled elastomer, and it is built with reinforcing plies of cloth, wire and/or cords.

16. The cover support of claim 14 wherein an exposed part of the body perimeter has a coefficient of static friction to steel of at least about 0.4 and acts as an integral retention component against the shoulder of the existing manhole cover receiving structure.

17. The cover support of claim 14 wherein the exposed part of the body perimeter reacting against the shoulder of the existing manhole cover receiving structure is overlaid with a flexible retention component and seal element that is bonded to body, said component and seal element having a coefficient of static friction to steel of at least about 0.4.

18. The cover support of claim 14 wherein the exposed part of the body perimeter reacting against the shoulder of the existing manhole cover receiving structure is overlaid with a flexible retention component and seal element that is not bonded to the body, said component and seal element having a coefficient of static friction to steel of at least about 0.4.

19. The cover support of claim 1 wherein a seal element disposed around the outer perimeter of the body is a gas-filled tube.

20. The cover support of claim 16 wherein an exposed part of the body surface acts as the ledge for support of the cover as well as an integral seal element for the cover placed thereover.

21. A manhole cover support adapted for accommodating a layer of paving around its outer perimeter and a manhole cover therewithin while raising the effective grade of an existing manhole cover receiving structure, the existing receiving structure having a manhole cover sill and an inside shoulder surface ascending therefrom, the manhole cover support comprising:

a body that has at least one adjustable joint equipped with a spreader for rendering the cover support adjustable in its outer perimeter dimension and a base with a ledge for supporting the manhole cover, the body consisting essentially of an expansible metal frame with polymeric material over it, the spreader being capable of creating a gap in the base upon expansion of the body, the ledge having a lateral cover keeper arising therefrom, the base having an outer wall, at least part of which is adapted to react around the outer perimeter of the base against said shoulder surface upon expansion of the body as a result of spreader operation;

a plurality of deformable seal elements integral with the polymeric material of the body, said seal elements comprising elastomer and having Shore A hardness of 20–70, one of the seal elements being disposed on the ledge and at least one other of said seal elements being disposed around the outer perimeter of the body including at least the outer wall of the base thereof, the seal element around the outer wall of said base being sufficiently thick for obtaining continuity of contact between said outer wall and said shoulder surface, the continuity being interrupted only by the gaps in the base, the minimum thickness of the seal element around the outer wall of the base being about 20 mils, the maximum about 600 mils, the coefficient of static friction of the seal element around said outer wall with respect to said shoulder surface substantially exceeding the coefficient of static friction obtainable directly between said outer wall and said shoulder surface;

a compressible plug for each said adjustable joint, the plugs comprising synthetic or natural resin-containing material and being interactable with the seal elements at the gaps to block the substantial infiltration of surface water into the manhole.

22. A manhole cover support adapted for accommodating a layer of paving around its outer perimeter and a manhole cover therewithin while raising the effective grade of an existing manhole cover receiving structure, the existing receiving structure having a manhole cover sill and an inside shoulder surface ascending therefrom, the manhole cover support comprising:

a body that consists essentially of ferrous metal, has at least one adjustable joint equipped with a spreader for rendering the cover support adjustable in its outer perimeter dimension and has a base with a ledge for supporting the manhole cover, the ledge having a lateral cover keeper arising therefrom, each spreader being capable of creating a gap in the base upon expansion of the body;

a plurality of deformable seal elements bonded to the body, said seal elements comprising elastomer and having a Shore A hardness of 20–70, one of the seal elements being disposed on the ledge and at least one other of the seal elements being disposed substantially around the outer perimeter of the body including at least the outer wall of the base thereof, the seal element around the outer wall of said base being sufficiently thick for obtaining continuity of contact between said outer wall and said shoulder surface, the continuity being interrupted only by the gaps in the base, the thickness of the seal element around the outer wall of the base being about 60–400 mils;

the coefficient of static friction of the seal element around said outer wall with respect to said shoulder surface substantially exceeding the coefficient of static friction obtainable directly between said outer wall and said shoulder surface; and a plug comprising a sealant for each said adjustable joint, the plugs being interactable with the seal elements to block the substantial infiltration of surface water into the manhole.

* * * * *